US007121213B2

(12) United States Patent
Viazanko et al.

(10) Patent No.: US 7,121,213 B2
(45) Date of Patent: Oct. 17, 2006

(54) LEGLESS DECK TABLE

(76) Inventors: Keith Alan Viazanko, 3551 Fort Dr., Waterford, MI (US) 48328; Ken R. Viazanko, 7332 White Swan La., Ludington, MI (US) 49431-9476

( * ) Notice: Subject to any disclaimer, the term of this patent is extended or adjusted under 35 U.S.C. 154(b) by 0 days.

(21) Appl. No.: 10/906,873

(22) Filed: Mar. 10, 2005

(65) Prior Publication Data

US 2006/0042521 A1 Mar. 2, 2006

Related U.S. Application Data

(60) Provisional application No. 60/604,771, filed on Aug. 26, 2004.

(51) Int. Cl.
*A47B 23/00* (2006.01)

(52) U.S. Cl. ..... 108/42; 108/90

(58) Field of Classification Search ..... 108/42, 108/48, 44, 90, 49, 47; 248/229.11, 229.12, 248/229.21, 227.22
See application file for complete search history.

(56) References Cited

U.S. PATENT DOCUMENTS 392,257 A * 11/1888 Cameron
2,797,973 A * 7/1957 Culpepper ..... 108/43
3,011,847 A 12/1961 Rader
3,146,986 A * 9/1964 Gorth, Jr. ..... 248/447
3,810,598 A * 5/1974 Bender ..... 248/219.2
4,494,465 A 1/1985 Fick, Jr.
4,986,505 A * 1/1991 Zabawski et al. ..... 248/214
5,240,214 A * 8/1993 Birnbaum et al. ..... 248/231.41
5,566,609 A * 10/1996 Kirschner ..... 108/42
5,884,568 A * 3/1999 Dombroski ..... 108/42
5,899,147 A * 5/1999 Clayton ..... 108/42
6,012,690 A * 1/2000 Cohen ..... 248/231.41
6,059,300 A * 5/2000 Wu ..... 248/229.12
6,082,270 A * 7/2000 Zerger ..... 108/42
6,308,641 B1 10/2001 Kingbury
6,984,066 B1 * 1/2006 Borom ..... 108/42

* cited by examiner

*Primary Examiner*—José V. Chen
(74) *Attorney, Agent, or Firm*—Thomas E. Donohue; Artz & Artz, P.C.

(57) ABSTRACT

A legless table is provided. The legless table includes a tabletop, a first support, a track, a fastener and a second support whereby the legless table is selectively attachable to an upright protrusion. The tabletop includes an upper surface and a lower surface where the first support is coupled to the lower surface. The track is located on the lower surface of the tabletop and forms a slot. Further, the fastener is positionably retained in the slot and is used to positionably secure the second support to the lower surface of the tabletop.

20 Claims, 3 Drawing Sheets

LEGLESS DECK TABLE

CROSS-REFERENCE TO RELATED APPLICATIONS

This application claims the benefit of U.S. Provisional Application No. 60/604,771, filed Aug. 26, 2004, and entitled "Legless Deck Table."

TECHNICAL FIELD

The present invention relates generally to tables, and more particularly, to legless tables used in portably attachable situations.

BACKGROUND DESCRIPTION

Tables come in a variety of sizes, shapes and types. Most notable is the traditional table having legs positioned at each corner and used to support an upper surface. The upper surface is used for placing a variety of objects on it or doing tasks thereupon. Tables may be placed or used in many locations including inside or outside, such as in a kitchen, on a back patio, or at a park. A typical requirement in order to use a table is that there needs to be sufficient space and a nearly flat surface in which to place the legs. A traditional table may not adequately work in situations where there is minimal space or an upright protrusion is found upon the surface. Furthermore, a traditional table may not be so conveniently stored because the legs protrude from its surface. In order to overcome these difficulties, proposed solutions in the prior art have included tables with adjustable legs, as shown by U.S. Pat. No. 4,494,465, that enable the table to jump the upright protrusion of a car trunk by making multiple adjustments of the various legs, the legs being foldable up to the table surface; a legless table having cantilevered surfaces as shown by U.S. Pat. No. 3,011,847 where the table is cantilevered across a trunk wall and attached to the bottom of a trunk by requiring perforation or modification to the attachment structure; and a legless table as shown by U.S. Pat. No. 6,308,641 pivotally cantilevered to a wall and storable therein to conserve space but is not portable. The aforementioned solutions being suitable to a particular need are not suited to various other situations.

Accordingly, a solution is needed that may provide a table that is mountable in situations where there may be a protrusion within the table location such as a deck rail or trunk wall, or where there is limited space such as on a balcony or between the seats of an airplane. A solution is also needed enhancing the portability and self-storing capabilities of the table.

SUMMARY OF THE INVENTION

It is therefore an advantage of the present invention to provide a legless deck table.

It is a further advantage of the present invention to provide a legless deck table that is conveniently storable without disassembly of its parts.

It is still a further advantage of the present invention to provide a legless deck table that is conveniently removable without disassembly of its parts.

It is another advantage of the present invention to provide a legless deck table that is detachably connectable to an upright protrusion.

It is yet another advantage of the present invention to provide a legless deck table that is conveniently attachable to an upright surface without modification of the upright surface.

It is still yet a further advantage of the present invention to provide a legless deck table that is conveniently portable.

In accordance with the above and the other advantages of the present invention, a legless deck table is provided. The legless table includes a tabletop, a first support, a track, a fastener and a second support whereby the legless table is selectively attachable to an upright protrusion. The tabletop includes an upper surface and a lower surface where the first support is coupled to the lower surface. The track is located on the lower surface of the tabletop and forms a slot. Further, the fastener is positionably retained in the slot and is used to positionably secure the second support to the lower surface of the tabletop.

Other aspects and advantages of the present invention will become apparent upon the following detailed description and appended claims, and upon reference to the accompanying drawings.

DETAILED DESCRIPTION OF THE INVENTION

Figure 1:
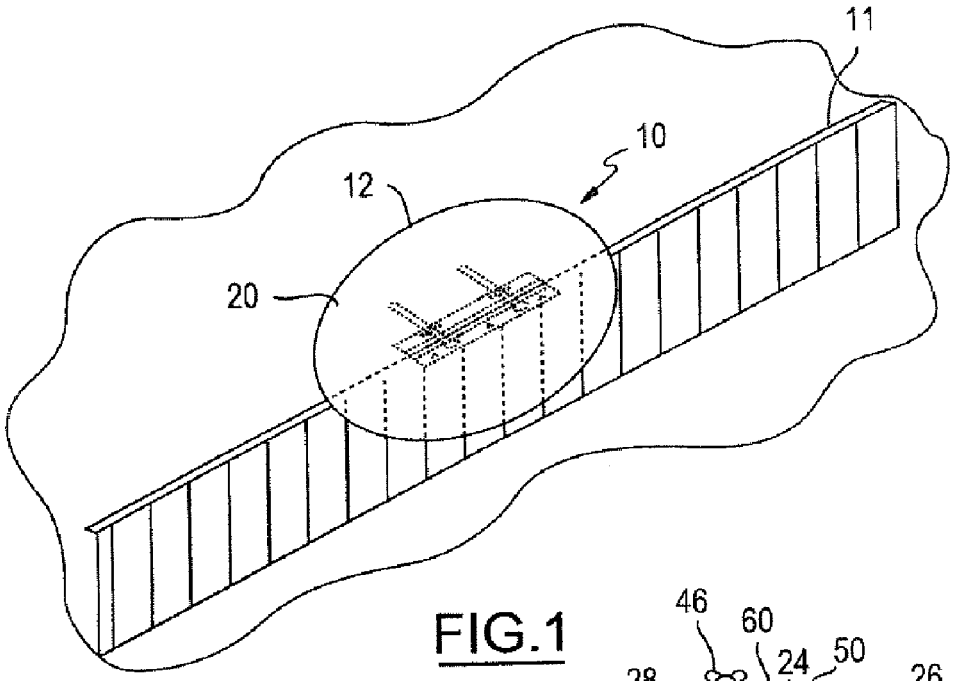
FIG. 1 is a perspective view of the legless deck table being used to advantage in accordance with one embodiment of the present invention.

As shown in the attached drawings, the present invention relates to a legless deck table 10. FIG. 1 is a perspective view of the legless deck table being used to advantage in accordance with one embodiment of the present invention. The legless deck table 10 may be removably, adjustably positioned upon a deck rail 11 or upon any other upright protrusion, e.g., such as an armrest or wall.

Figure 3:
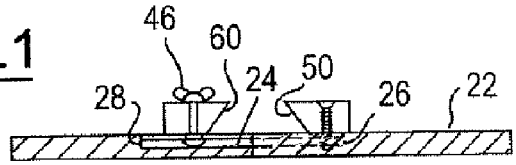
FIG. 3 is a cross-sectional view of the legless deck table as indicated in FIG. 2.
Figure 2:
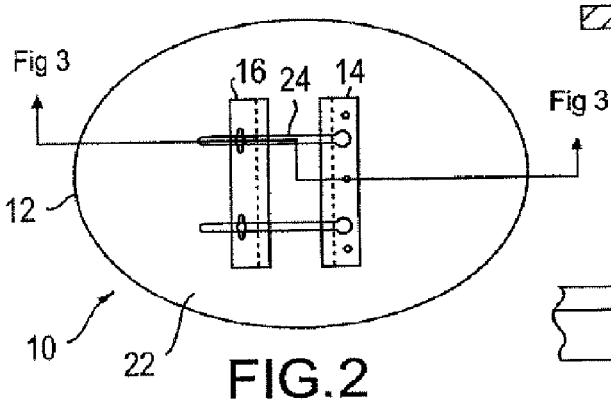
FIG. 2 is a plan view of the legless deck table in accordance with the embodiment shown in FIG. 1.
Figure 5:
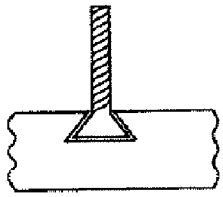
FIG. 5 shows a partial cross-sectional view of a slot in accordance with a first embodiment of the present invention.
Figure 6:
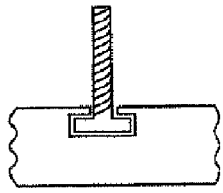
FIG. 6 shows a partial cross-sectional view of a slot in accordance with a second embodiment of the present invention.

FIG. 2 is a plan view of the legless deck table in accordance with the embodiment shown in FIG. 1. The legless deck table 10 is an assembly having a tabletop 12, a fixed rail support 14, and a movable rail support 16. The tabletop 12 has a top side 20, being essentially flat and usable to advantage, and a bottom side 22. The tabletop 12 is depicted as an ellipse, but may have any other shape. The bottom side 22 is constructed with one or more track 24. As shown in FIG. 3, the track 24 has a slot with a "T" shape. Further, FIG. 6 shows a partial cross-sectional view of a "T" shape slot. Optionally, it is recognized that each track 24 may have different internal shapes such as a wedge shape, as shown in FIG. 5, or the "T" shape slot shown in FIG. 6 for forming a slot 30 in which a fastener or form-fitting fastener may be positionably retained. It is recognized that the slot may have any shape such that the fastener may be retained over the primary length of the track 24, without separation or loss of the fastener from the track when the legless deck table 10 is in its assembled construction.

Figure 4A:
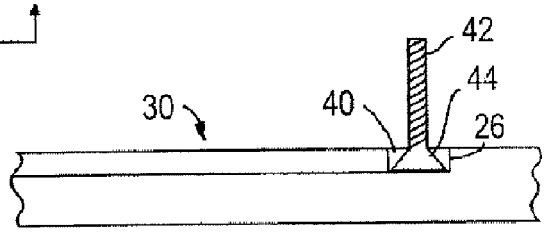
FIG. 4A is a partial cross-sectional side view of the legless deck table having a track in accordance with the present embodiment.
Figure 4B:
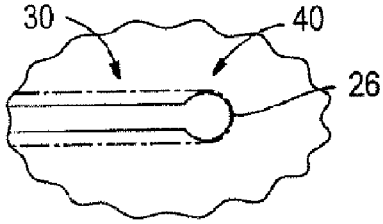
FIG. 4B is a partial cross-sectional bottom view of the legless deck table having a track in accordance with the present embodiment.

As shown in the partial cross-sectional views of FIG. 4A and FIG. 4B, each track 24 has an insertion end 26 connected over a distance to a terminal end 28. The shape of slot 30 of the track continues from just past the insertion end 26 and continues through the terminal end 28. Alternatively, the slot 30 may have any shape consistent with the intent of this disclosure that is capable of retaining a fastener, slide fastener, or even a head of a bolt.

At the insertion end 26 a through passage 40 is provided wherein the head 44 of a bolt 42, or other equivalent fastener may be positionably inserted into the through passage 40 and engaged into the slot 30 of the track 24.

Optionally, each track may have an insert that is integrally constructed within the tabletop. Also, the track may be formed from a separate member, which is securely attached to the tabletop using known fasteners and adhesives.

Figure 7:
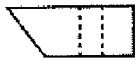
FIG. 7 shows a side view of the rail support in accordance with a first embodiment of the present invention.
Figure 8:
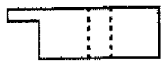
FIG. 8 shows a side view of the rail support in accordance with a second embodiment of the present invention.
Figure 9:
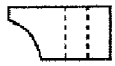
FIG. 9 shows a side view of the rail support in accordance with a third embodiment of the present invention.

As shown in FIG. 3 and FIG. 7, the fixed rail support 14 has a first profile surface 50 and is fixedly attached to the bottom surface 22 of the tabletop 12. In one embodiment the first profile surface 50 is formed in a wedge shape to facilitate attachment to a rail 11. Alternatively, as shown in FIG. 8 and FIG. 9, the first profile surface may have any form-fitting shape desirable to effectuate the attachment between the legless deck table 10 and an upright structure. In the embodiment shown in FIG. 2 and FIG. 3, the fixed rail support 14 is fixedly attached to the bottom surface 22 of the tabletop 12 covering the through passage 40.

Also shown in FIG. 2 and FIG. 3, the movable rail support 16 has a second profile surface 60 and is adjustably attached to the bottom surface 22 of the tabletop 12. In this embodiment the second profile surface 60 is formed in a wedge shape for attachment to a rail 11. Alternatively, the second profile surface may have any form-fitting shape desirable to effectuate the attachment between the legless deck table 10 and an upright structure. In this regard, the first profile surface and the second profile surface need not have the same shape and may even have various shapes including contoured, oblique, form-fitting, custom, and perpendicular shaped surfaces for attachment to the numerous types of upright surfaces.

Returning back to FIG. 3, the movable rail support 16 is sandwiched between a wing nut 46 and a bolt head 44 of bolt 42 positioned in the slot 30. The movable rail support 16 is reversibly positionable on the tabletop 12 by releasing the sandwich force between the wing nut 46 and the bolt head 44 and then repositioning the movable rail support 16. Alternatively, the sandwich force required to secure the movable rail support 16 to the track 24 of the tabletop 12 may be accomplished with other fasteners including, for example, a bolt and nut, a toggle latch, a slide fastener, or a quick release clamp.

Figure 12:
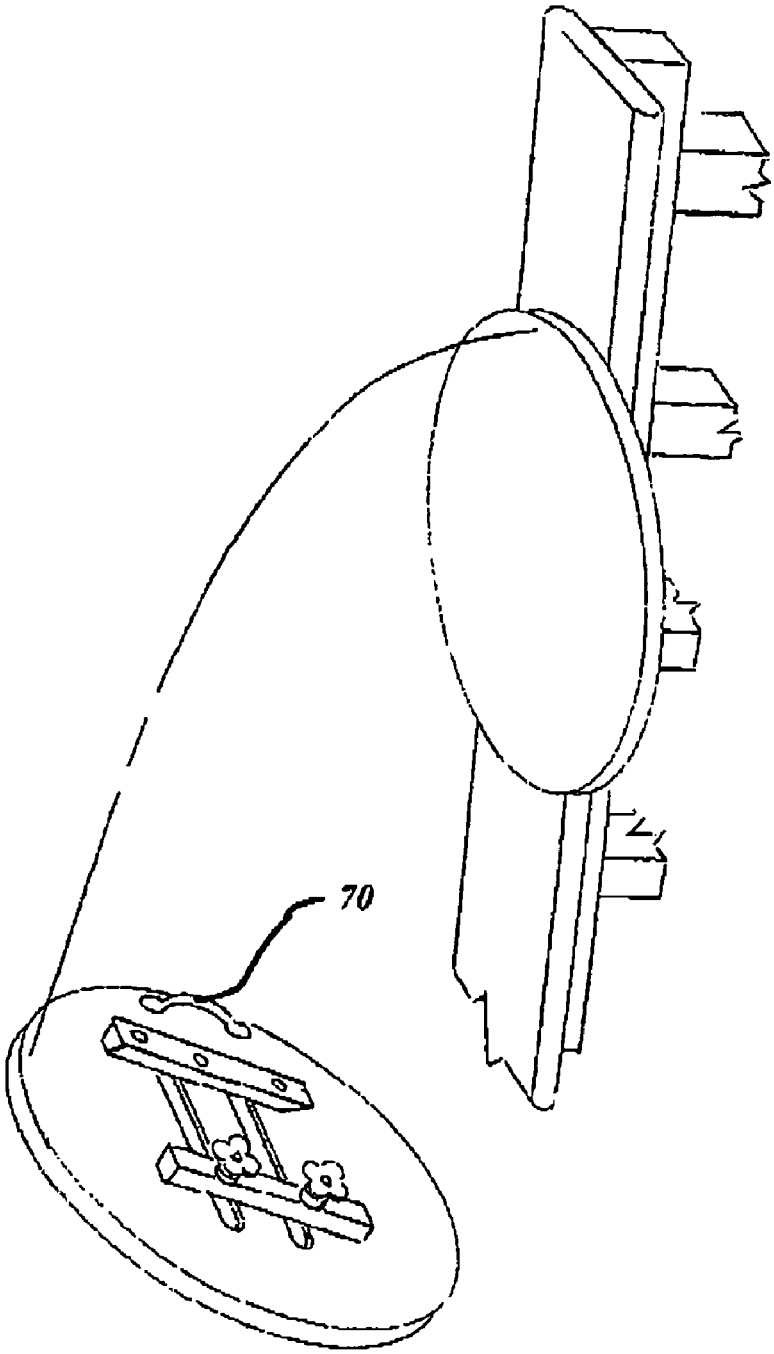
FIG. 12 is a perspective view of still another legless deck table being used to advantage in accordance with the present invention.

In use, shown by FIG. 1, the legless deck table 10 may releasably engage an upright structure by positioning the first profile surface 50 of the fixed rail support 14 up to the upright structure, positioning the second profile surface 60 of the movable rail support 16 up to the structure, and then securing the movable rail support 16 to the tabletop 12. Likewise, FIG. 12 is a perspective view of still another legless deck table being used to advantage in accordance with the present invention.

Figure 10:
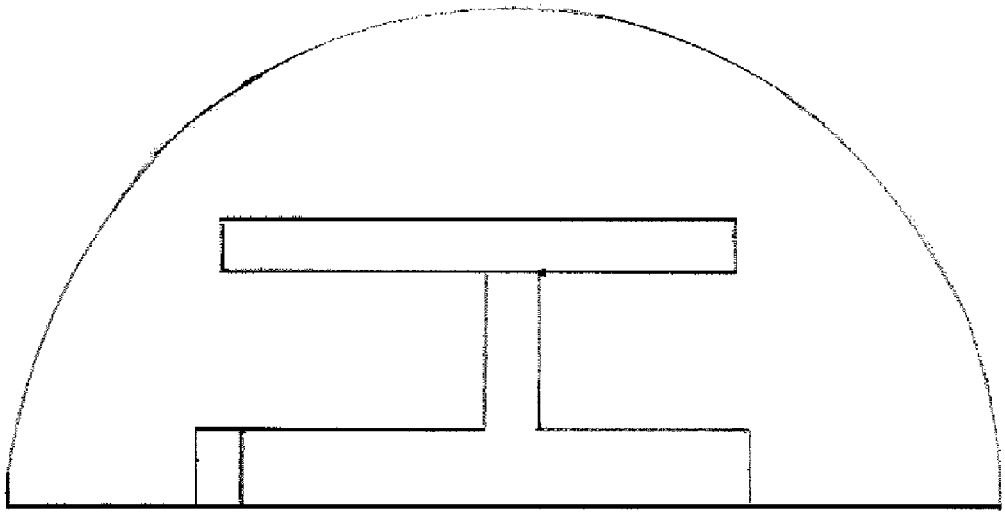
FIG. 10 shows a plan view of another legless deck table in accordance with the present invention.
Figure 11:
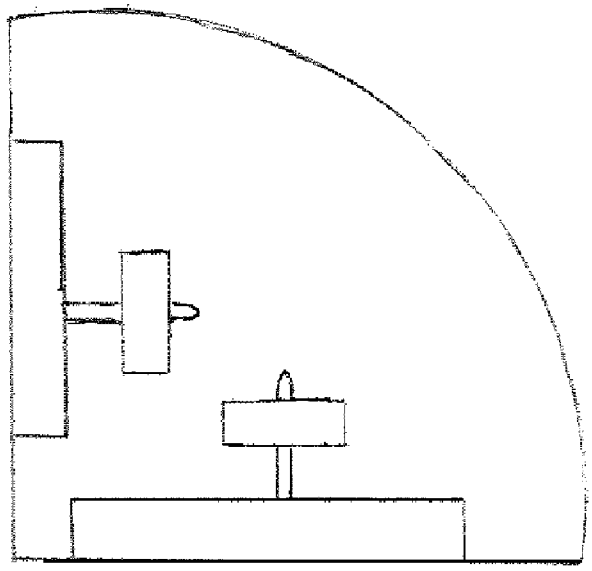
FIG. 11 shows a plan view of yet another legless deck table in accordance with the present invention.

FIG. 10 shows a plan view of another legless deck table in accordance with the present invention. FIG. 11 shows a plan view of yet another legless deck table in accordance with the present invention. FIG. 12 is a perspective view of still another legless deck table being used to advantage in accordance with the present invention. The present invention includes alternative features as optionally shown in the Figures. Specifically, the present invention may have one or more track. Each track may be positioned essentially parallel to the motion of the movable rail support to which it guides. The fixed rail support may be made from multiple parts. There may be more than one fixed rail support. The movable rail support may be made from multiple parts, with at least one track for each part. There may be more than one movable rail support. There may be sets of fixed rail support and movable rail support. The tabletop may be of any shape, half shape, or corner shape. The movable rail support or fixed rail support may have different profile surfaces on one or more of the faces of the rail support; The rail support may have one profile surface on at least one face and optionally have another profile surface on at least one other face. It should be noted that a rail support having at least two profile surfaces will provide additional versatility to the table by allowing a user to mount and configure the rail support to the table top with the profile surface needed in order to best utilize the table.

In accordance with the present invention presented, the legless dock table may be conveniently attached to the top of an upright protrusion, wall or rail. The legless deck table does not require modification to the attaching structure for it to be attached thereto. The legless deck table is an assembly having a tabletop having one or more tracks, a fixed rail support coupled to the tabletop, and a movable rail support positionably coupled in the track of the tabletop. The fixed rail support is coupled to the tabletop covering the track so as to maintain the positionably coupled movable rail support from disengaging the track of the tabletop during normal use. The legless deck table is conveniently storable without disassembly of its constituent part. The legless deck table may be conveniently removed without disassembly by adjusting and repositioning the movable rail support. The legless deck table may be provided with a handle or grasp 70 to enhance portability as shown in FIG. 12. The legless deck table may be constructed from materials used In table construction such as wood, plastic, or metal. In order to improve the portability and durability feature of the table, a material that is lightweight yet rigid such as a composite, fiberglass on wood, aluminum alloy, oak, or reinforced plastic may be used to advantage. While specific materials of construction have been indicated, they are not intended to limit the present invention. Also, the choices of fasteners are well known in the art and therefore the present invention may include various fastener types and is not to be limited by the fasteners previously presented.

While the invention has been described in connection with one or more embodiments, it should be understood that the invention is not limited to those embodiments. On the contrary, the invention is intended to cover all alternatives, modifications, and equivalents, as may be included within the spirit and scope of the appended claims.

What is claimed is:

1. A legless table comprising:

a tabletop having at least an upper surface and a lower surface;

at least one first support coupled to said lower surface;

at least one track located in said lower surface forming a slot, said track includes an insertion end having a through passage and a terminal end, wherein said slot extends from said insertion end to said terminal end;

at least one fastener positionably retained in said slot and receivable into said slot through said through passage of said insertion end of said track; and at least one second support positionably coupled to said lower surface by said fastener, wherein said fastener is positionably retained between said first support and said terminal end of said track and said first support preventing removal of said fastener through said through passage, whereby the legless table is selectively attachable to an upright protrusion.

2. The legless table according to claim 1, wherein said top surface is flat and is elliptical in area.

3. The legless table according to claim 1, wherein said slot is a T-shaped slot extending along said track.

4. The legless table according to claim 1, wherein said slot is a V-shaped slot extending along said track.

5. The legless table according to claim 1, wherein said fastener is releasably reengageable over a primary length of said track thereby enhancing said second support positionability.

6. The legless table according to claim 1, wherein said fastener is positionably retained in said track without separation therefrom.

7. The legless table according to claim 1, wherein said fastener comprises a bolt and a wing nut, wherein said bolt having a head substantially congruent with said slot, and positionably retained therein.

8. The legless table according to claim 1, wherein said first support is coupled to said lower surface covering said insertion end.

9. The legless table according to claim 1, wherein said first support has a first profile surface and said second support has a second profile surface, whereby said surfaces are selectively engageable to an upright protrusion.

10. The legless table according to claim 9, wherein said first profile surface of said first support or said second profile surface of said second support is a form fitting surface, whereby said surfaces are selectively form fitting for engagement to an upright protrusion.

11. The legless table according to claim 1, wherein said first support is fixedly coupled to said table.

12. The legless table according to claim 1, wherein said track is integrally constructed in said lower surface of said tabletop.

13. The legless table according to claim 1, wherein said track is reinforced.

14. The legless table according to claim 1, wherein said track is made from a material that together with the tabletop material reinforces the fastening strength of said slot.

15. The legless table according to claim 1, further comprising a handle coupled to the tabletop.

16. A table comprising:

a platform having at least an upper surface and a lower surface;

at least one fixed rail support having a first profile surface, said fixed rail support coupled to said lower surface;

at least one track located in said lower surface forming a slot, said track includes an insertion end having a through passage and a terminal end, wherein said slot extends from said insertion end to said terminal end;

at least one fastener positionably retainable in said slot and received into said slot through said through passage of said insertion end of said track; and at least one movable rail support having a second profile surface, said movable rail support positionably coupled to said lower surface by said fastener, wherein said fastener is positionably retained between said fixed rail support and said terminal end of said track and said fixed rail support preventing removal of said fastener through said through passage, whereby the platform is selectively attachable to an upright protrusion positioned between said profile surfaces of said fixed rail support and said movable rail support.

17. The table according to claim 16, wherein each track may be integral or attachable to said platform.

18. The table according to claim 16, wherein said profile surfaces are wedge shaped.

19. A table without legs comprising:

a surface means having at least an upper surface and a lower surface;

a first profile means coupled to said lower surface;

at least one track located in said lower surface having a slot means;

a fastening means positionably retainable by said slot means; and a second profile means positionably coupled to said lower surface by said fastening means, wherein said fastening means is positionably retained by said slot means and said first profile means prevents removal of said fastening means from said slot means, whereby the legless table is selectively attachable to an upright protrusion where the upright protrusion is in engaging contact with said profile means.

20. The table according to claim 19, further comprising more than one of a first profile means or a second profile means.

* * * * *